US007498744B2

(12) United States Patent
Song

(10) Patent No.: US 7,498,744 B2
(45) Date of Patent: Mar. 3, 2009

(54) PLASMA DISPLAY PANEL AND METHOD OF FABRICATING THE SAME

(75) Inventor: Jung-Suk Song, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 199 days.

(21) Appl. No.: 11/204,471

(22) Filed: Aug. 16, 2005

(65) Prior Publication Data

US 2006/0038492 A1 Feb. 23, 2006

(30) Foreign Application Priority Data

Aug. 18, 2004 (KR) ..... 10-2004-0065038

(51) Int. Cl.
*H01J 17/49* (2006.01)

(52) U.S. Cl. ..... 313/582; 313/587

(58) Field of Classification Search ..... 313/582–587; 315/169.1, 169.4

See application file for complete search history.

(56) References Cited

U.S. PATENT DOCUMENTS

| | | | | |
|---|---|---|---|---|
| 6,531,819 | B1 * | 3/2003 | Nakahara et al. | 313/584 |
| 7,067,979 | B2 * | 6/2006 | Sakamoto | 313/584 |
| 2004/0189199 | A1 * | 9/2004 | Komaki et al. | 313/582 |
| 2004/0245929 | A1 * | 12/2004 | Sakamoto | 313/584 |

FOREIGN PATENT DOCUMENTS

| | | | |
|---|---|---|---|
| JP | 2001-216901 | | 8/2001 |
| JP | 2002-170493 | | 6/2002 |
| JP | 2003-257321 | | 9/2003 |
| JP | 2004039578 | A * | 2/2004 |
| JP | 2004-241379 | | 8/2004 |
| JP | 2004-281310 | | 10/2004 |
| JP | 2005-011744 | | 1/2005 |
| JP | 2005-209637 | | 8/2005 |
| JP | 2006-059808 | | 3/2006 |
| WO | WO 03032356 | A1 * | 4/2003 |

* cited by examiner

*Primary Examiner*—Toan Ton
*Assistant Examiner*—Hana A Sanei
(74) *Attorney, Agent, or Firm*—Knobbe Martens Olson & Bear LLP

(57) ABSTRACT

A plasma display panel and a method of fabricating the same are disclosed. In one embodiment, the plasma display panel includes i) a front substrate, ii) a rear substrate disposed to face the front substrate, iii) a dielectric wall disposed between the front and rear substrates to define discharge cells with the front and rear substrates, and having portions of different heights from each other, iv) a pair of sustain discharge electrodes including an X electrode and a Y electrode, embedded in the dielectric wall, and disposed to surround a discharge corner of the discharge cell, v) an address electrode embedded in the dielectric wall and disposed in a direction of crossing the Y electrode, and vi) red, green, and blue phosphor layers applied in the discharge cells. In one embodiment, a predetermined gap is formed between the front substrate and the dielectric wall due to a height difference between the portions of the dielectric wall where the address electrode is formed and is not formed, respectively. Accordingly, an exhaustion of impure gas can be performed sufficiently, and thus, the impure gas can be reduced and a discharge smear at the center portion of the panel can be removed.

14 Claims, 6 Drawing Sheets

PLASMA DISPLAY PANEL AND METHOD OF FABRICATING THE SAME

CROSS-REFERENCE TO RELATED PATENT APPLICATIONS

This application claims the benefit of Korean Patent Application No. 10-2004-0065038, filed on Aug. 18, 2004, in the Korean Intellectual Property Office, the disclosure of which is incorporated herein in its entirety by reference.

BACKGROUND OF THE INVENTION

1. Field of the Invention

The present invention relates to a plasma display panel, and more particularly, to a plasma display panel including a dielectric wall which covers discharge electrodes arranged along a circumference of a discharge cell, and a method of fabricating the same.

2. Description of the Related Technology

In general, a plasma display panel is a flat panel display device, in which a discharge gas is injected between two substrates to generate a discharge. Phosphor layers are excited by ultraviolet rays generated due to the discharge, to display desired numbers, characters, and images.

Referring to FIG. 1, a conventional plasma display panel 100 includes a front substrate 110, a rear substrate 120 facing the front substrate 110, an X electrode 131 and a Y electrode 134 disposed on an inner surface of the front substrate 110. The panel 100 also includes a front dielectric layer 140 covering the X and Y electrodes 131 and 134, a protective layer 150 coated on the front dielectric layer 140, an address electrode 160 formed on an inner surface of the rear substrate 120. The panel 100 further includes a rear dielectric layer 170 covering the address electrode 160, a barrier rib 180 disposed between the front and rear substrates 110 and 120, and red, green, and blue phosphor layers 190 formed in the barrier rib 180.

The X electrode 131 includes a first transparent electrode line 132, and a first bus electrode line 133 formed on the first transparent electrode line 132. The Y electrode 134 includes a second transparent electrode line 135, and a second bus electrode line 136 formed on the second transparent electrode line 135.

In the plasma display panel 100 including the above structure, an electric signal is applied to the Y electrode 134 and the address electrode 160 to select a discharge cell. Once the discharge cell is selected, an electric signal is alternately applied to the X and Y electrodes 131 and 134 to generate a surface discharge from the inner surface of the front substrate 110 and to generate ultraviolet radiation. Visible light is emitted from the phosphor layers 190 in the selected discharge cell to display a still image or a moving picture.

Once the substrates 110 and 120 and the barrier rib 180 are assembled, a vacuum exhaustion process is performed via i) a hole (not shown) defined in, typically, the rear substrate 120, and ii) a pipe (not shown; typically a glass pipe) connected to the hole, so as to remove impure gas from the interior of the panel 100. The hole and pipe are also used to inject a discharge gas, and the hole is sealed after the gas injection. In the conventional display panel 100, the barrier rib 180 of matrix type defines the discharge cells, and the discharge cells have four closed sides. In addition, there is almost no space between the lower portion of the front substrate 110 and the upper end portion of the barrier rib 180. This "tight fit" structure makes it difficult to remove impure gas from the center portion (directed to the barrier rib 180) of the front substrate 110 where generally a great deal of impure gas exists since no exhaustion path of impure gas is provided in that area during the vacuum exhaustion process.

Therefore, the exhaustion of impure gas cannot be performed sufficiently during the vacuum exhaustion process. Consequently, the impure gas remains in the panel 100, and thus, it shortens the lifetime of the panel 100, and problems such as a permanent residual image and an unstable discharge can be generated.

In addition, the discharge starts from a discharge gap between the X and Y electrodes 131 and 134, and is diffused to the outer portion of the X and Y electrodes 131 and 134. Thus, the discharge is diffused along the plane of the front substrate 110, resulting in poor space usability of the discharge cell.

Since the X electrode 131, Y electrode 134, the front dielectric layer 140, and the protective layer 150 are formed on the inner surface of the front substrate 110, the transmittance of the visible light cannot reach even 60%. Therefore, the brightness is reduced.

In a case where the plasma display panel 100 is driven for a long time, the discharge diffuses toward the phosphor layer 190. Accordingly, the charged particles of the discharge gas, sputtered on the phosphor layer 190 due to the electric field, cause a permanent residual image.

In addition, when the high concentration Xe gas of 10 volume % or more is filled in the discharge cell, ionization and excitation of the electrons cause generation of excitons, and thus, the brightness and the discharge efficiency can increase. However, since the high concentration Xe gas is used, an initial discharge firing voltage becomes high.

SUMMARY OF CERTAIN INVENTIVE ASPECTS

One aspect of the present invention provides a plasma display panel capable of improving discharge efficiency by disposing discharge electrodes along circumferences of discharge cells and generating a facing discharge in a diagonal direction in the discharge cell, and a method of fabricating the plasma display panel.

Another aspect of the present invention provides a plasma display panel, in which an exhaustion process can be sufficiently performed by forming a space between a substrate and a dielectric wall.

Another aspect of the present invention provides a plasma display panel capable of performing addressing process at high speed by covering Y electrodes and address electrodes in the dielectric wall.

Another aspect of the present invention provides a plasma display panel. In one embodiment, the panel includes i) a front substrate, ii) a rear substrate disposed to face the front substrate, iii) a dielectric wall disposed between the front and rear substrates to define discharge cells with the front and rear substrates, and having portions of different heights from each other, iv) a pair of sustain discharge electrodes including an X electrode and a Y electrode, embedded in the dielectric wall, and disposed to surround a discharge corner of the discharge cell, v) an address electrode embedded in the dielectric wall and disposed in a direction of crossing the Y electrode, and vi) red, green, and blue phosphor layers formed in the discharge cells.

In one embodiment, the dielectric wall may include a first dielectric wall disposed along a direction of the panel, and a second dielectric wall extending from the adjacent first dielectric wall so as to cross the first dielectric wall, and the height of the first dielectric wall may be lower than that of the second dielectric wall.

In one embodiment, the address electrode may be disposed in the second dielectric wall in substantially parallel to the second dielectric wall, and may not be disposed in the first dielectric wall.

In one embodiment, a predetermined gap may be formed between the first dielectric wall and the front substrate to provide an exhaustion path of impure gas.

In one embodiment, the X electrode may be disposed to surround a first discharge corner of the discharge cell, and the Y electrode may be disposed to surround a second discharge corner at a diagonal direction from the first discharge corner in the discharge cell.

In one embodiment, the X and Y electrodes may be disposed at the same plane, and the address electrode may be disposed on an upper portion or a lower portion of the Y electrode.

Still another aspect of the present invention provides a method of fabricating a plasma display panel. In one embodiment, the method includes i) preparing a transparent substrate, ii) forming an X electrode and a Y electrode on the substrate, iii) patterning a raw material for forming a first dielectric wall in order to cover the X and Y electrodes in the first dielectric wall, iv) drying and baking the raw material for the first dielectric wall, v) patterning an address electrode on the raw material for the first dielectric wall in a direction of crossing the Y electrode, vi) patterning a raw material for forming a second dielectric wall in order to cover the address electrode, and vii) drying and baking the raw material for the second dielectric wall to form the first and second dielectric walls having different heights from each other.

In one embodiment, the X and Y electrodes may be disposed along a circumference of the discharge cell to surround the discharge corners diagonally formed with each other in the discharge cell.

In one embodiment, the address electrode may be disposed along the circumference of the discharge cell, and may be formed on an upper portion of the Y electrode in a direction of crossing the Y electrode.

In one embodiment, the height of the dielectric wall where the address electrode is not formed may be lower than that of the dielectric wall where the address electrode is formed due to the contraction during the baking process.

BRIEF DESCRIPTION OF THE DRAWINGS

Embodiments of the present invention will be described with reference to the attached drawings.

DETAILED DESCRIPTION OF CERTAIN INVENTIVE EMBODIMENTS

Figure 1:
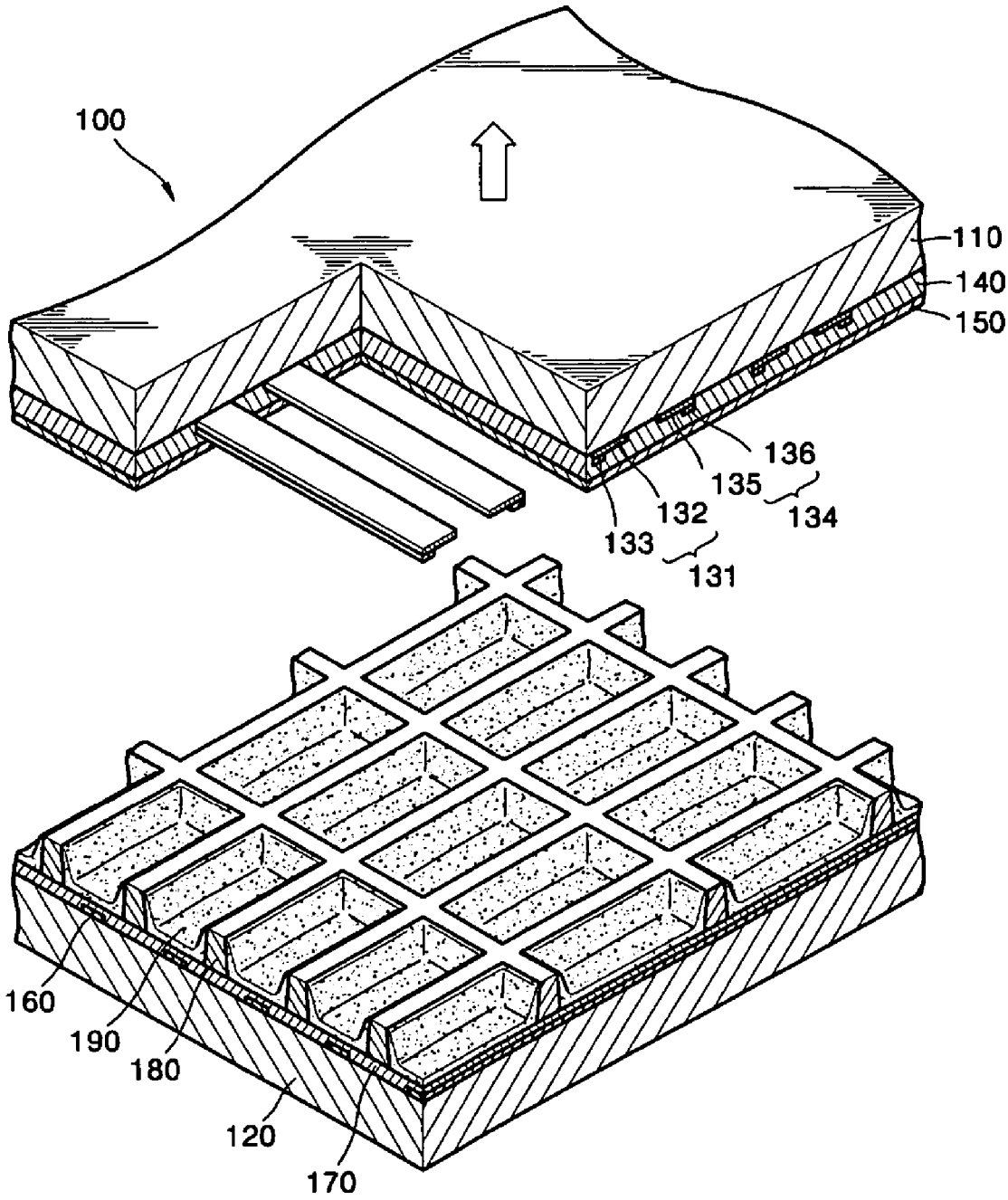
FIG. 1 (PRIOR ART)
FIG. 1 is an exploded perspective view of a conventional plasma display panel.
Figure 2:
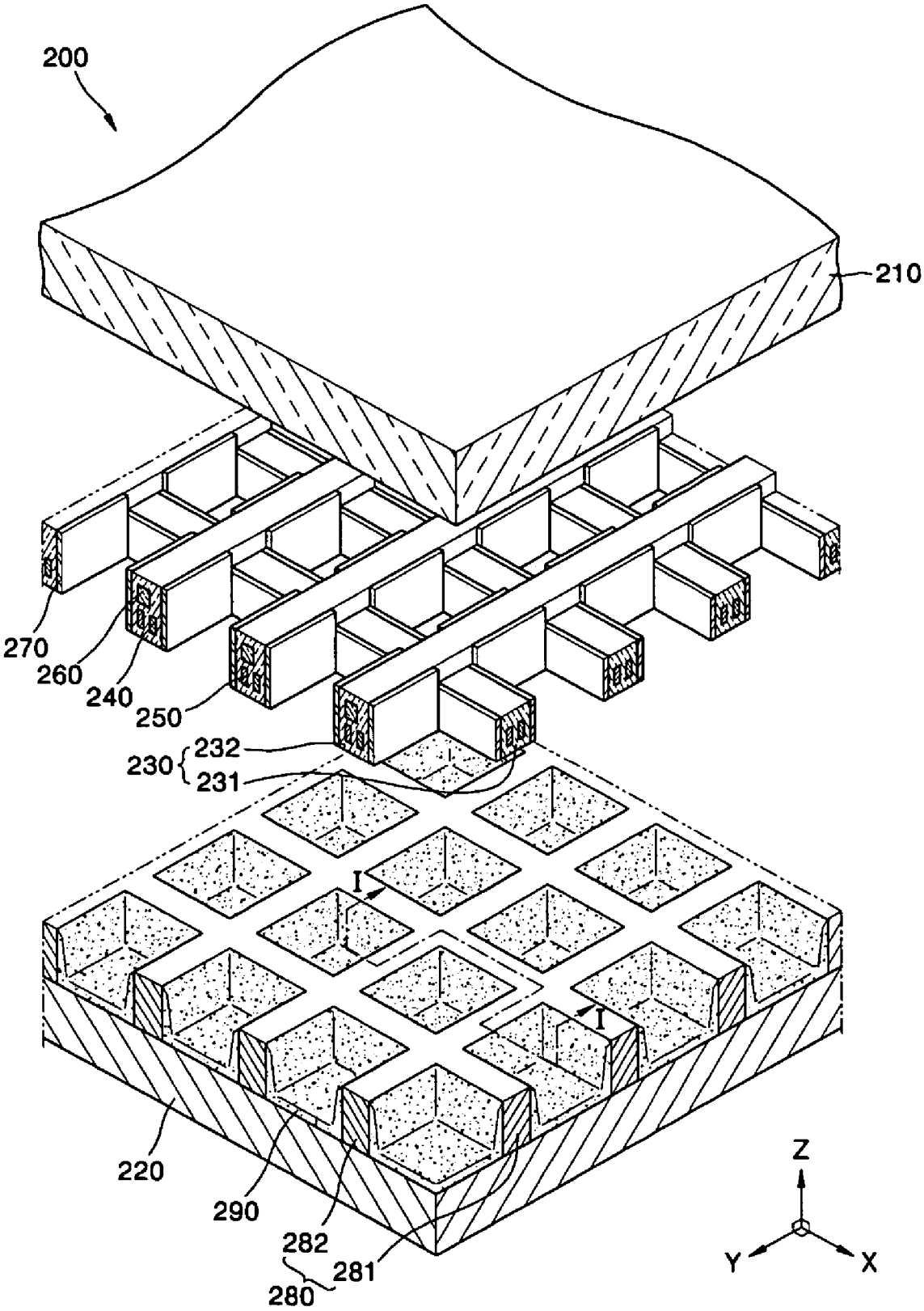
FIG. 2 is an exploded perspective view of a plasma display panel according to a first embodiment of the present invention.

FIG. 2 shows a part of a plasma display panel 200 according to one embodiment of the present invention.

Referring to FIG. 2, the plasma display panel 200 includes a front substrate 210, and a rear substrate 220 disposed in parallel to the front substrate 210.

The front substrate 210 is generally formed of a transparent substrate, for example, soda lime glass. The rear substrate 220 is typically formed of the same material as that of the front substrate 210.

A dielectric wall 230 is disposed between the front substrate 210 and the rear substrate 220 to define discharge cells with the front and rear substrates 210 and 220. In one embodiment, the dielectric wall 230 is formed by adding various fillers in glass paste.

In one embodiment, the dielectric wall 230 includes a first dielectric wall 231 disposed in an X direction of the panel 200, and a second dielectric wall 232 disposed in a Y direction of the panel 200. In one embodiment, the first dielectric wall 231 extends from inner walls of adjacent pair of the second dielectric walls 232 toward each other, and the coupled first and second dielectric walls 231 and 232 are formed as matrix type.

In another embodiment, the dielectric wall 230 can be formed as a meander type, a delta type, a hexagon type, or a honeycomb type. In one embodiment, the discharge cell defined by the dielectric wall 230 can be formed in other polygon shape, or circular shape, if it defines the discharge space.

An X electrode 240 and a Y electrode 250 forming a sustain discharge electrode pair, and an address electrode 260 are embedded in the dielectric wall 230. In one embodiment, the X electrode 240, the Y electrode 250, and the address electrode 260 are disposed along the circumference of the discharge cell, and the electrodes 240-260 are electrically insulated with each other.

A protective layer 270 formed of, for example, MgO is deposited on inner surfaces of the dielectric wall 230 so as to emit secondary electrons.

Barrier ribs 280 are formed between the dielectric wall 230 and the rear substrate 220. In one embodiment, the barrier ribs 280 are formed of a low dielectric material, unlike the dielectric wall 230. In one embodiment, the barrier ribs 280 are formed in the same shape as the dielectric wall 230 at the portion corresponding to the dielectric wall 230.

That is, the barrier ribs 280 include a first barrier rib 281 disposed in parallel to the first dielectric wall 231 (X direction), and a second barrier rib 282 disposed in parallel to the second dielectric wall 232 (Y direction). In one embodiment, the first and second barrier ribs 281 and 282 form a matrix shape.

In one embodiment, if the dielectric wall 230 is formed only between the front and rear substrates 210 and 220, the discharge cells are defined by a single wall. In another embodiment, if the dielectric wall 230 and the barrier rib 280 are formed between the front and rear substrates 210 and 220 as in FIG. 2, the discharge cells are defined by dual-walls formed of the materials having different dielectric properties.

A discharge gas such as Ne—Xe or He—Xe is injected into the discharge cell defined by the front substrate 210, the rear substrate 220, the dielectric wall 230, and the barrier rib 280.

Red, green, and blue phosphor layers 290 that are excited by ultraviolet ray generated due to the discharge gas are formed in the discharge cells. In one embodiment, each phosphor layer 290 can be coated on anywhere in the discharge cell. In another embodiment, the phosphor layer 290 is coated on the inner walls of the barrier rib 280 and on an upper surface of the discharge cell at a predetermined thickness in the present embodiment.

The red, green, or blue phosphor layer 290 is coated on each discharge cell. In one embodiment, the red phosphor layer is formed of $(Y,Gd)BO_3:Eu^{+3}$, the green phosphor layer is formed of $Zn_2SiO_4:Mn^{2+}$, and the blue phosphor layer is formed of $BaMgAl_{10}O_{17}:Eu^{2+}$.

In one embodiment, the sustain discharge electrode pair, that is, the X and Y electrodes 240 and 250 generate discharge cater-cornered in the discharge cell. In this embodiment, the address electrode 260 is disposed at upper or lower portion of the Y electrode 250 in a direction of crossing the Y electrode 250, and heights of the first and second dielectric walls 231 and 232 are different from each other.

Figure 3:
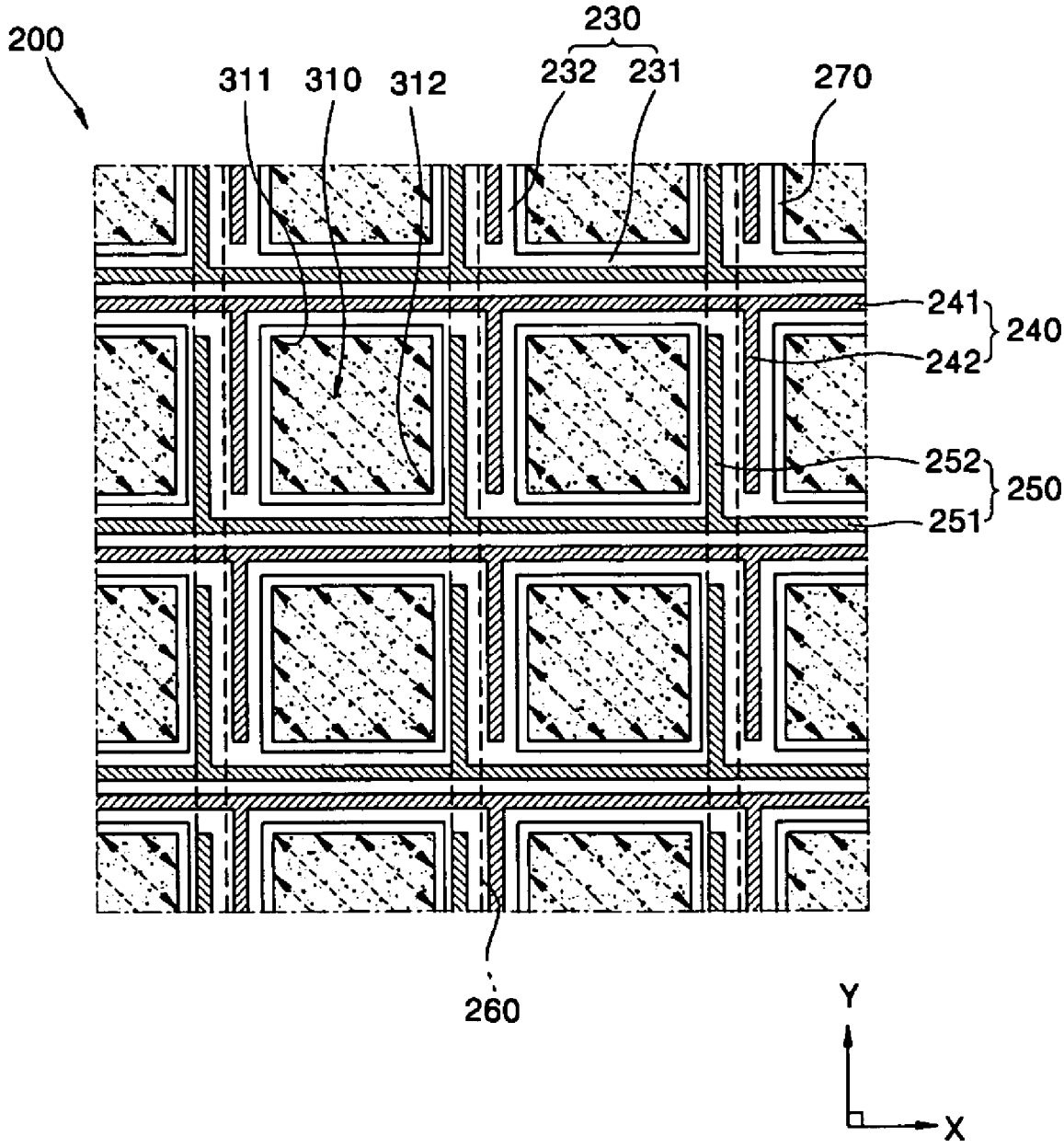
FIG. 3 is a plane view of arrangement of discharge electrodes shown in FIG. 2.
Figure 4:
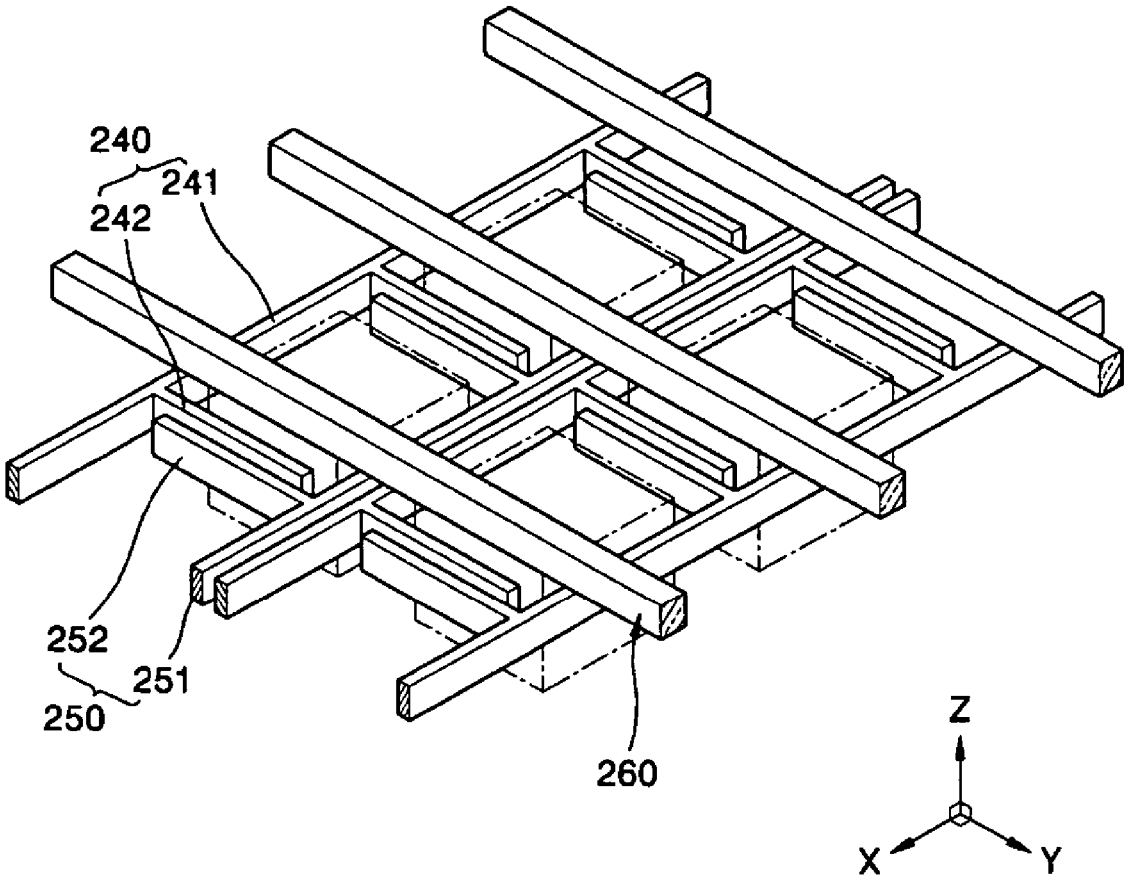
FIG. 4 is an exploded perspective view of the discharge electrodes shown in FIG. 2.
Figure 5:
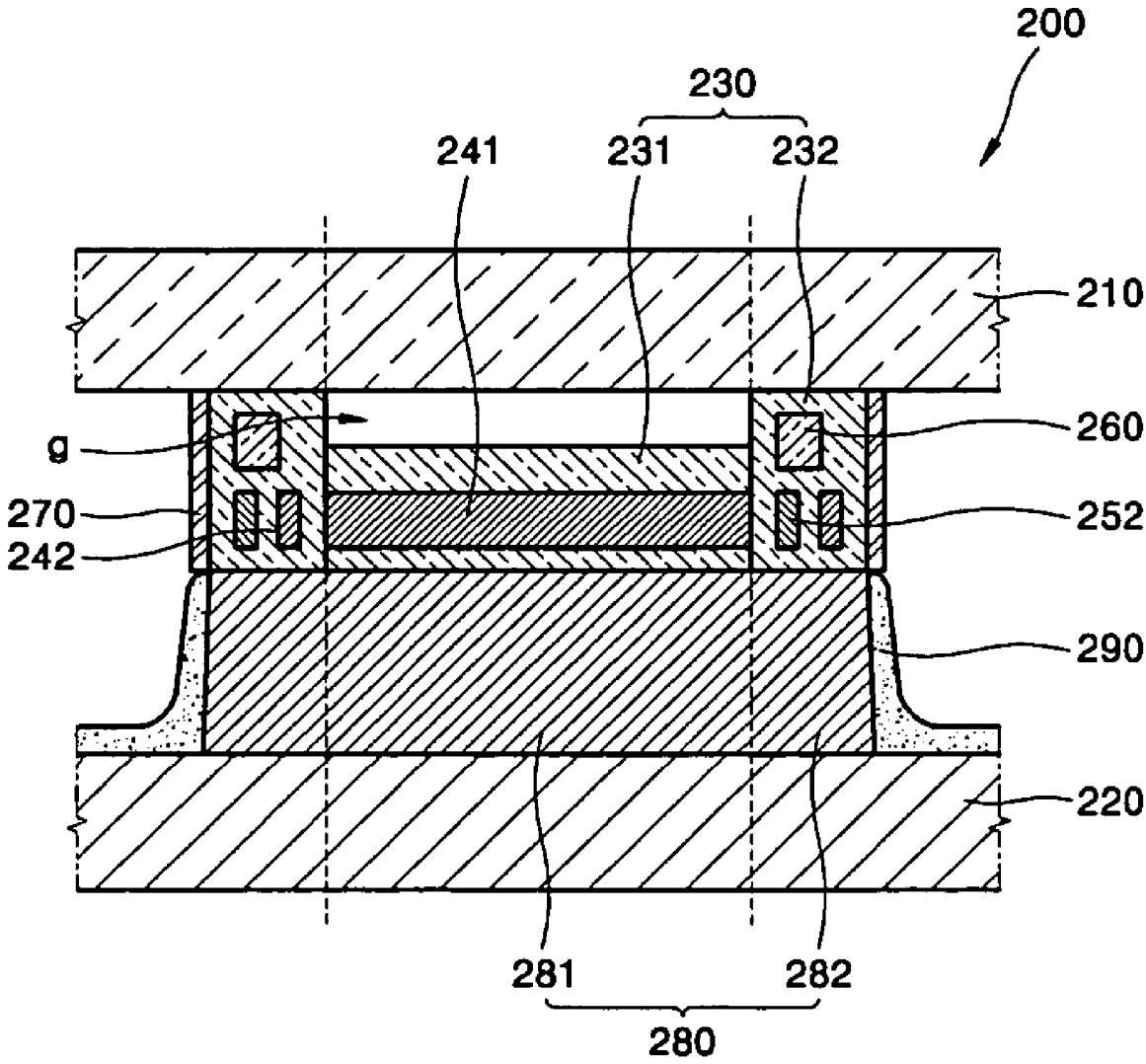
FIG. 5 is a cross-sectional view of the plasma display panel of FIG. 2 taken along line I-I in a status where the panels are coupled to each other.

FIG. 3 is a plan view of the discharge electrodes of FIG. 2, FIG. 4 is a perspective view of the discharge electrodes in FIG. 3, and FIG. 5 is a cross-sectional view of the panel taken along line I-I of FIG. 3.

Referring to FIGS. 3 through 5, the plasma display panel 200 includes the first dielectric wall 231 and the second dielectric wall 232 coupled to the first dielectric wall 231. In one embodiment, the discharge cell 310 formed by coupling the first and second dielectric walls 231 and 232 is formed as a square. In one embodiment, the discharge cells 310 are arranged successively along the X and Y directions of the panel 200 with constant intervals therebetween.

The X and Y electrodes 240 and 250, and the address electrode 260 are embedded in the dielectric wall 230. The X electrode 240 is disposed to surround a first discharge corner 311 of the discharge cells 310, and the Y electrode 250 is disposed to surround a second discharge corner 312 that is diagonal to the first discharge corner 311. In addition, the address electrode 260 is disposed to cross the Y electrode 250.

The X electrode 240 includes an X electrode line 241 disposed in the X direction of the discharge cell 310. In one embodiment, the X electrode line 241 is formed as a strip. In one embodiment, one X electrode line 241 is disposed at each first dielectric wall 231, and may have partially different volumes in order to reduce line resistance.

An X electrode protrusion 242 protrudes from the X electrode line 241 in the Y direction of the discharge cell 310. In one embodiment, the X electrode protrusion 242 is formed integrally from the X electrode line 241. The length of the X electrode protrusion 242 corresponds to the side of the discharge cell 310 in the Y direction. One X electrode protrusion 242 is disposed at each second dielectric wall 232.

In one embodiment, the X electrode 240 is formed as a comb along the X direction of the discharge cell 310 by coupling the X electrode line 241 and the X electrode protrusion 242.

The Y electrode 250 is disposed in a direction parallel to the X electrode 240 from the side of the discharge cell 310 facing the X electrode 240.

The Y electrode 250 includes a Y electrode line 251 disposed in the X direction of the discharge cell 310. The Y electrode line 251 is disposed at each discharge cell 310 while forming a pair with the X electrode line 241, and is disposed at the opposing side of the X electrode line 241 in the discharge cell 310. In one embodiment, the Y electrode line 251 is formed as a strip, and one Y electrode line 251 is disposed at each first dielectric wall 231.

A Y electrode protrusion 252 protrudes from the Y electrode line 251 in the Y direction of the discharge cell 310. In one embodiment, the Y electrode protrusion 252 is formed integrally from the Y electrode line 251. The length of the Y electrode protrusion 252 corresponds to the side of the discharge cell 310 in the Y direction. One Y electrode protrusion 252 is disposed at each second dielectric wall 232.

As described above, the Y electrode line 251 and the Y electrode protrusion 252 are coupled to each other, and thus, the Y electrode 250 is formed as a comb along the X direction of the discharge cell 310.

In one embodiment, the X electrode line 241 and the X electrode protrusion 242 surround the first discharge corner 311. In this embodiment, the Y electrode 251 and the Y electrode protrusion 252 surround the second discharge corner 312 diagonal to the first discharge corner 311. In another embodiment, the X and Y electrodes 240 and 250 are not limited to the above structure if these can surround the discharge corners cater-cornered in each discharge cell.

In one embodiment, the address electrode 260 is disposed on the upper portion of the Y electrode 250. The address electrode 260 is adjacent to the front substrate 210, and the Y electrode 250 is adjacent to the rear substrate 220. In another embodiment, the address electrode 260 can be disposed under the Y electrode 250.

The address electrode 260 crosses the Y electrode line 251, and is disposed parallel to the Y electrode protrusion 252. One address electrode 260 is disposed at each second dielectric wall 232.

The X electrode 240, the Y electrode 250, and the address electrode 260 are disposed along the circumference of the discharge cell 310, not in the discharge cell 310, which means that those electrodes do not block the light transmittance path. Therefore, the X, Y, and the address electrodes 240, 250, and 260 are irrelevant to the aperture rate of the panel 200, and thus, these electrodes 240, 250, and 260 can be formed of an opaque material having high conductivity such as Ag paste, or Cr—Cu—Cr.

In one embodiment, the first dielectric wall 231 and the second dielectric wall 232 are formed to have different heights from that of each other.

That is, the address electrode 260 is disposed in the second dielectric wall 232. The address electrode 260 is disposed in the Y direction of the discharge cell 310. In addition, the X and Y electrode protrusions 242 and 252 concerning different discharge cells 310 from each other are disposed under the address electrode 260 in the second dielectric layer 232.

In one embodiment, the address electrode 260 is not disposed in the first dielectric wall 231. In addition, the X and Y electrode lines 241 and 251 concerning different discharge cells 310 from each other are disposed in the first dielectric wall 231.

In one embodiment, the X and Y electrode lines 241 and 251, and the X and Y electrode protrusions 242 and 252 have the same thickness and connected integrally to each other.

Accordingly, as shown in FIG. 5, a gap (g) is created between the heights of the first dielectric wall 231 and the second dielectric wall 232 as much as the thickness of the address electrode 260. That is, in the above embodiment, since the address electrode 260 is installed in the second dielectric wall 232 and is not installed in the first dielectric wall 231, the first dielectric wall 231 contracts more than the second dielectric wall in the baking process since the first dielectric wall 231 does not include the address electrode 260. Accordingly, the first and second dielectric walls 231 and 232 have different heights from each other in the baking process, and thus, the predetermined gap (g) is generated between them.

Processes for fabricating the dielectric wall 230 will be briefly described as follows.

The front and rear substrates 210 and 220 are formed of transparent glass. A suitable raw material is printed and formed on the rear substrate 220 to form the barrier rib 280 of, for example, a matrix type. After forming the barrier rib 280, raw materials for forming red, green, and blue phosphor layers are repeatedly coated inside of the barrier rib 280 by the colors, and dried and baked to form the red, green, and blue phosphor layers 290.

Next, raw material for forming the X and Y electrodes is printed and formed, and thus, the comb-shaped X and Y electrodes 240 and 250 facing each other on the circumferences of the discharge cell are patterned.

In addition, a raw material for the first dielectric wall is printed, dried, and baked on the address electrode 260 to cover the address electrode 260, and thus, the dielectric wall 230 of matrix type can be completed. A suitable raw material is deposited on the inner surface of the dielectric layer 230 to form the protective layer 270.

Here, during the baking process, the first dielectric wall 231 that does not include the address electrode 260 contracts relatively more than the second dielectric wall 232, which includes the address electrode 260.

Therefore, the first and second dielectric walls 231 and 232 are formed to have different heights from each other, and the predetermined gap (g) is generated between the first dielectric wall 231 and the front substrate 210.

The gap (g) provides an exhaustion path of the impure gas remaining in the panel assembly during a vacuum exhaustion process, and the impure gas can be exhausted from the center portion of the panel 200, where a lot of impure gas remains, discharge smears at the center portion of the panel can be removed.

In another embodiment, the dielectric wall 230, the X and Y electrodes 240 and 250 formed in the dielectric wall 230, and the address electrode 260 can be formed from the inner surface of the front substrate 210, not the rear substrate 220.

In addition, the address electrode 260 can be disposed under the X and Y electrodes 240 and 250. Therefore, the structure of the dielectric wall is not limited to the above example if it has at least a portion having different height from other portions to form a stepped structure and can form the exhaustion path of the impure gas.

Operations of the plasma display panel 200 having the above structure will be described as follows.

When a predetermined pulse voltage is applied between the address electrode 260 and the Y electrode 250 from an external power source, a discharge cell 310 that will emit light is selected. Wall charges are accumulated on inner side surfaces of the selected discharge cell 310.

Here, the address electrode 260 and the Y electrode 250 are disposed separately in the upper and lower portions in the dielectric wall 230, the address electrode 260 and the Y electrode protrusion 252 are disposed parallel to each other along the Y direction of the discharge cell 310.

As described above, since the distance between the address electrode 260 and the Y electrode 250 becomes shorter than that of the conventional art, the pulse voltage applied between the address electrode 260 and the Y electrode 250 can be lower than that of the conventional art, in which the address electrode is disposed on the rear substrate. In addition, the addressing speed between the address electrode 260 and the Y electrode 250 increases.

In addition, when a positive voltage is applied to the X electrode 240 and relatively higher voltage is applied to the Y electrode 250, the wall charges move due to the difference between the voltages applied to the X and Y electrodes 240 and 250.

Here, the X electrode 240 surrounds the first discharge corner 311 of the discharge cell 310, and the Y electrode 250 surrounds the second discharge corner 312 of the discharge cell 310 disposed at a diagonal direction with respect to the first corner 311.

The wall charges collide with discharge gas atoms in the discharge cell 310 to generate a discharge and generate plasma, and the discharge starts from the first corner 311 and the second corner 312 where the strong electric fields are formed and diffused to the center of the discharge cell 310.

After generating the discharge, when the voltage difference between the X electrode 240 and the Y electrode 250 becomes lower than the discharge voltage, the discharge does not occur, and space charges and wall charges are formed in the discharge cell 310.

Here, if the polarities of voltages applied to the X and Y electrodes 240 and 250 are changed, the discharge occurs again with the help of the wall charges. As described above, when the polarities of the X and Y electrodes 240 and 250 change in the opposite one, respectively, and the initial discharge process is repeated. Through the above repeated processes, the discharge is generated in a stable way.

The ultraviolet radiation generated by the discharge excites the phosphor materials of the phosphor layers 290 applied in the discharge cells 310. Through this process, visible light is emitted from the discharge cell 310 to display a still image or a moving picture image.

Figure 6:
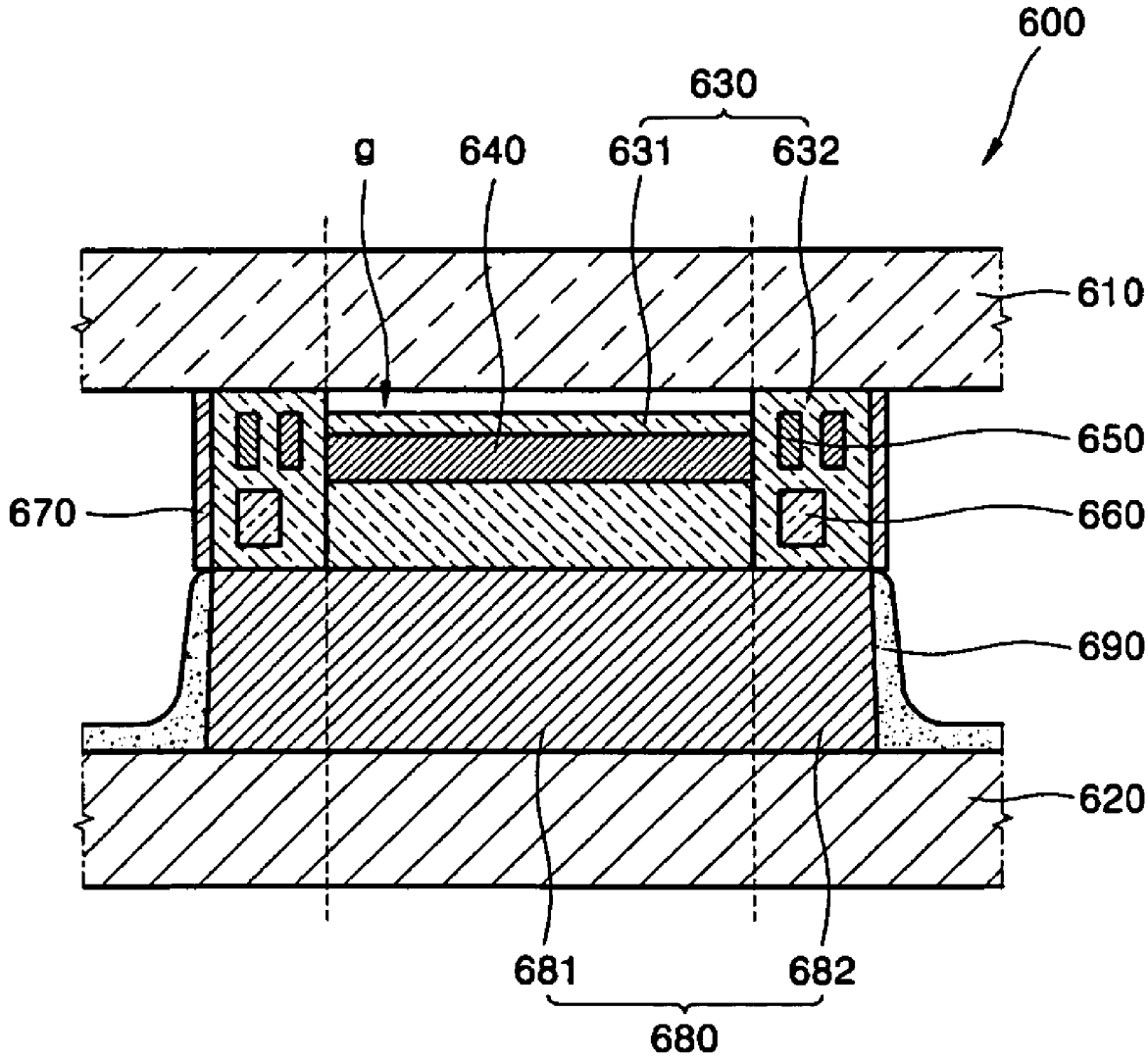
FIG. 6 is a cross-sectional view of a plasma display panel according to a second embodiment of the present invention.

FIG. 6 shows a plasma display panel 600 according to a second embodiment of the present invention.

Referring to FIG. 6, the plasma display panel 600 includes a front substrate 610 and a rear substrate 620. A dielectric wall 630 and a barrier rib 680 are disposed between the front and rear substrates 610 and 620 to correspond to each other in a vertical direction. The barrier rib 680 includes a first barrier rib 681, and a second barrier rib 682 crossing the first barrier rib 681 to form a matrix form. Red, green, and blue phosphor layers 690 are coated inside of the barrier rib 680.

Here, X and Y electrodes 640 and 650 are embedded in the dielectric wall 630 along two opposing sides of the discharge cell to surround discharge corners which are on the same diagonal in the discharge cell. An address electrode 660 is disposed underneath the Y electrode 650 to cross the Y electrode 650. The Y electrode 650 is adjacent to the front substrate 610, and the address electrode 660 is adjacent to the rear substrate 620.

In addition, the dielectric wall 630 includes a first dielectric wall 631 disposed to correspond to the first barrier rib 681, and a second dielectric wall 631 crossing the first dielectric wall 631 to form a matrix.

Here, the first dielectric wall 631 that does not include the address electrode 660 contracts more than the second dielectric wall 632 including the address electrode 660 during the drying and baking processes of the dielectric wall 630. Accordingly, a gap (g) is generated between the front substrate 610 and the first dielectric wall 631, and the gap (g) becomes an exhaustion path of the impure gas during the vacuum exhaustion process.

As described above, the plasma display panel and the method of fabricating the panel according to embodiments of the present invention will generally provide the following effects.

Since the dielectric wall where the address electrode is disposed and the dielectric wall where the address electrode is not disposed are formed to have different heights, a predetermined gap is formed between the substrate and the dielectric wall. Accordingly, the exhaustion of the impure gas through the gap is more complete, and thus, the impure gas remaining in the panel assembly is reduced and the discharge smear at the center portion of the panel is prevented.

In addition, the discharge starts from the discharge corners of the discharge cell and is diffused to the center portion of the discharge cell, and thus, the discharge efficiency may be enhanced. In addition, since the path of ion particles is formed in a horizontal direction with respect to the phosphor layer in the sustain discharge operation, the ion sputtering of the phosphor layer may be prevented, and the lifetime of the panel may increase.

Since the Y electrode and the address electrode are embedded in the dielectric wall, the distance between the electrodes may be reduced, and low voltage operating and high speed addressing may be performed.

In addition, the discharge occurs along the side surfaces of the discharge cell, and thus, a more efficient usage of the discharge space can be obtained.

In addition, the discharge electrodes, the dielectric layer, and the protective layer are not formed on the inner surface of the substrate, through which visible light is transmitted, and thus, the aperture rate of the panel can be greatly improved.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display panel, comprising:

a front substrate;

a rear substrate disposed to face the front substrate;

a dielectric wall disposed between the front and rear substrates to define discharge cells with the front and rear substrates, and having portions with heights that are different with respect to one another;

a pair of sustain discharge electrodes including an X electrode and a Y electrode, embedded in the dielectric wall, and disposed to surround a discharge corner of a respective discharge cell;

an address electrode embedded in the dielectric wall and disposed in a direction to cross the Y electrode; and a plurality of types of phosphor layers formed in the discharge cells so as to selectively emit light, wherein each of the X, Y and address electrodes is positioned so as not to block the transmission path of the light, and wherein the X electrode is disposed to surround a first discharge corner of a respective discharge cell, and the Y electrode is disposed to surround a second discharge corner of the discharge cell, and wherein the second discharge corner is located on a diagonal with respect to the first discharge corner.

2. The plasma display panel of claim 1, wherein the dielectric wall includes a plurality of first dielectric walls formed in a direction and a plurality of second dielectric walls formed so as to cross the plurality of first dielectric walls, and wherein the height of at least one of the first dielectric walls is lower than that of at least one of the second dielectric walls.

3. The plasma display panel of claim 2, wherein the address electrode is disposed only in each of the second dielectric walls and is in substantially parallel to a respective second dielectric wall.

4. The plasma display panel of claim 3, wherein a predetermined gap is formed between at least one of the first dielectric walls and the front substrate so as to provide an exhaustion path for impure gas.

5. The plasma display panel of claim 1, wherein the X electrode and the Y electrode are formed substantially parallel to each other.

6. The plasma display panel of claim 1, wherein the X electrode includes an X electrode line, and an X electrode protrusion extending from the X electrode line in a direction to surround the first discharge corner together with the X electrode line.

7. The plasma display panel of claim 6, wherein the Y electrode includes a Y electrode line, and a Y electrode protrusion extending from the Y electrode line in a direction to surround the second discharge corner together with the Y electrode line, and wherein the X and Y electrode protrusions are substantially parallel to each other.

8. The plasma display panel of claim 1, wherein the Y electrode includes a Y electrode line, and a Y electrode protrusion extending from the Y electrode line in a direction to surround the second discharge corner together with the Y electrode line.

9. The plasma display panel of claim 1, wherein the X and Y electrodes are disposed in the same plane, and the address electrode is disposed above or below the Y electrode.

10. The plasma display panel of claim 1, further comprising a barrier rib having a shape corresponding to the dielectric wall between the dielectric wall and the rear substrate, wherein each phosphor layer is formed inside of the barrier rib.

11. The plasma display panel of claim 1, further comprising a protective layer formed on inner surface of the dielectric wall so as to increase emission of secondary electrons.

12. A plasma display panel, comprising:

a first substrate through which light is emitted;

a second substrate opposing the first substrate; and a dielectric wall, substantially completely covering discharge electrodes and an address electrode, disposed between the first and second substrates to define discharge cells with the first and second substrates, and having portions with heights that are different with respect to one another, wherein the discharge electrodes comprise an X electrode and a Y electrode, embedded in the dielectric wall so as to surround a discharge corner of a respective discharge cell, wherein the X electrode surrounds a first discharge corner of a respective discharge cell, and the Y electrode surrounds a second discharge corner of the discharge cell, and wherein the second discharge corner is located on a diagonal with respect to the first discharge corner.

13. The plasma display panel of claim 12, wherein the dielectric wall includes a plurality of first dielectric walls formed in a first direction and a plurality of second dielectric walls formed in a second direction substantially perpendicular to the first direction, and wherein the height of at least one of the first dielectric walls is lower than that of at least one of the second dielectric walls so that a predetermined gap is formed between the lower dielectric wall and the first substrate.

14. A plasma display panel, comprising:

a first substrate through which light is emitted;

a second substrate opposing the first substrate; and a dielectric wall, substantially completely covering discharge electrodes and an address electrode, disposed between the first and second substrates to define discharge cells with the first and second substrates, and having portions with heights that are different with respect to one another, wherein the X electrode includes an X electrode line, and an X electrode protrusion that extends from the X electrode line so as to surround the first discharge corner together with the X electrode line, wherein the Y electrode includes a Y electrode line, and a Y electrode protrusion that extends from the Y electrode line so as to surround the second discharge corner together with the Y electrode line, and wherein the X and Y electrode protrusions are substantially parallel to each other.

* * * * *